US008556528B2

(12) United States Patent
Gardner et al.

(10) Patent No.: US 8,556,528 B2
(45) Date of Patent: Oct. 15, 2013

(54) APPLICATOR SYSTEM WITH ADJUSTABLE IMPLEMENT

(75) Inventors: Nick Gardner, Santa Monica, CA (US); Adrian C. Apodaca, Santa Monica, CA (US); Armando Villarreal, Santa Monica, CA (US)

(73) Assignee: HCT Asia Ltd, Central (HK)

( * ) Notice: Subject to any disclaimer, the term of this patent is extended or adjusted under 35 U.S.C. 154(b) by 675 days.

(21) Appl. No.: 12/689,527

(22) Filed: Jan. 19, 2010

(65) Prior Publication Data

US 2011/0176856 A1 Jul. 21, 2011

(51) Int. Cl.
*A46B 11/00* (2006.01)

(52) U.S. Cl.
USPC ..... 401/127; 401/122; 401/126

(58) Field of Classification Search
USPC ..... 401/126, 127, 129, 122, 121
See application file for complete search history.

(56) References Cited

U.S. PATENT DOCUMENTS

| | | | | |
|---|---|---|---|---|
| 4,165,755 | A | 8/1979 | Cassai | |
| 4,428,388 | A | 1/1984 | Cassai et al. | |
| 4,446,880 | A | 5/1984 | Gueret et al. | |
| 4,545,393 | A | 10/1985 | Gueret et al. | |
| 4,869,612 | A | 9/1989 | Mooney et al. | |
| 5,137,038 | A | 8/1992 | Kingsford | |
| 5,328,282 | A | 7/1994 | Charrier et al. | |
| 6,145,514 | A | 11/2000 | Clay | |
| 6,309,125 | B1 * | 10/2001 | Peters | 401/127 |
| 7,429,141 | B2 | 9/2008 | Habatjou | |
| 7,467,905 | B2 * | 12/2008 | Habatjou | 401/127 |
| 8,141,561 | B2 | 3/2012 | Thorpe et al. | |
| 2005/0249539 | A1 | 11/2005 | Habatjou | |
| 2006/0162736 | A1 | 7/2006 | Gray | |
| 2009/0044357 | A1 | 2/2009 | Chan et al. | |
| 2009/0071499 | A1 | 3/2009 | Wyatt et al. | |
| 2009/0097899 | A1 | 4/2009 | Carroll | |
| 2009/0194120 | A1 | 8/2009 | Pires et al. | |
| 2009/0194127 | A1 | 8/2009 | Pires et al. | |

FOREIGN PATENT DOCUMENTS

| | | | |
|---|---|---|---|
| CN | 101884463 | A | 11/2010 |
| DE | 10038850 | A1 | 2/2002 |
| EP | 2084986 | A2 | 8/2009 |
| EP | 2301379 | A1 | 3/2011 |
| JP | 2007068945 | A | 3/2007 |
| WO | WO9211785 | A1 | 7/1992 |
| WO | WO2007117091 | A1 | 10/2007 |
| WO | WO2010098997 | A1 | 9/2010 |

OTHER PUBLICATIONS

The GB Search Report mailed Sep. 28, 2011 for GB patent application No. 1109399.4, 6 pages.
"Givenchy Demesure Audacious Lashes Mascara," May 17, 2011, retrieved from the internet at <<http://www.fashionizers.com/perfumes-makeup/givenchy-demesure-audacious-lashes-mascara/>>, 9 pages.
Non-Final Office Action for U.S. Appl. No. 12/399,591, mailed on May 10, 2011, James Thorpe, "Mascara Applicators," 9 pages.

(Continued)

*Primary Examiner* — David Walczak
(74) *Attorney, Agent, or Firm* — Lee & Hayes, PLLC

(57) ABSTRACT

An applicator system for applying a product to a surface includes an adjustable implement comprising an applicator that is selectively pivotable at least about ninety degrees. By virtue of having an applicator that is selectively pivotable ninety degrees, the adjustable implement is capable of applying various products in multiple positions.

17 Claims, 7 Drawing Sheets

(56) References Cited

OTHER PUBLICATIONS

Non-Final Office Action for U.S. Appl. No. 12/976,772, mailed on Apr. 10, 2012, Dennis Jon Anderson et al., "Applicator With Extendable Implement" , 8 pages.

Final Office Action for U.S. Appl. No. 12/976,772, mailed on Nov. 7, 2012, Dennis Jon Anderson et al., "Applicator With Extendable Implement," 12 pages.

* cited by examiner

APPLICATOR SYSTEM WITH ADJUSTABLE IMPLEMENT

BACKGROUND

Devices exist for applying cosmetic or medicinal products to a body. Existing applicators are typically designed to apply mascara to eyelashes in one technique. For example, one applicator may be generally straight and have short, densely arrayed bristles and may be employed for applying mascara to eyelashes to achieve a desired effect (e.g., to volumize eyelashes). While another applicator may incorporate a bend and have longer, less densely arrayed bristles for applying mascara to eyelashes to achieve an alternative desired effect (e.g., to separate and define eyelashes).

Thus, existing applicators have limited functionality, and are not conducive to applying mascara to eyelashes using different techniques and/or different orientations. Accordingly, there remains a need in the art for improved applicator systems that allow application of mascara using different techniques and/or orientations to achieve multiple desired effects.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This application describes applicator systems and adjustable implements comprising an applicator that is selectively pivotable. In some examples, the applicator is pivotable at least about ninety degrees. The applicators of various adjustable implements may be interchangeable, such that a single adjustable implement may selectively have a variety of different applicators attached. By virtue of having an adjustable implement, devices according to this disclosure are adaptable to apply various different cosmetic, medicinal, and/or personal care products to a body at multiple angles and achieve multiple desired effects.

Generally, an applicator system according to this disclosure comprises a receptacle assembly and an adjustable implement. The receptacle assembly includes a reservoir for containing a product to be dispensed and, in some implementations, may comprise a shell housing the reservoir. The adjustable implement includes a selectively pivotable applicator with which product may be applied to a body with multiple positions of the applicator. In addition to the selectively pivotable applicator, the adjustable implement according to this disclosure generally comprises a cap with an actuator disposed therein. A hollow stem houses a linkage, to which the actuator disposed in the cap is mechanically coupled, and the pivotable applicator is disposed on the stem opposite the cap.

In various embodiments, the adjustable implements described herein may include an actuator disposed in a side portion of the cap or a top portion of the cap. Also, the actuator may comprise a button, a lever or switch-type actuator disposed in the cap. The adjustable implement may be removably coupled to the receptacle assembly by a variety of attachment means, such as by snap fit, by screw threads, by a twist lock mechanism, by magnetic force, by interference fit, combinations of any of the foregoing, or the like.

Illustrative Applicator System with Adjustable Implement

Figure 1C:
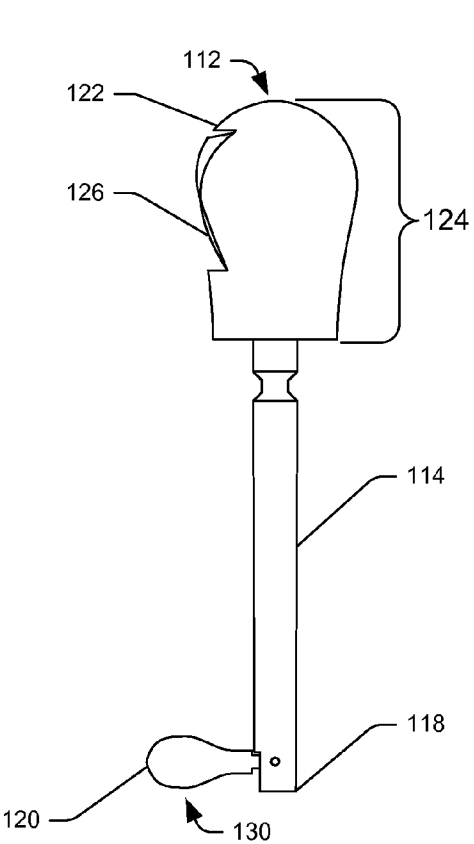
FIG. 1C depicts an illustrative adjustable implement housed by the applicator system of FIG. 1A.
Figure 1B:
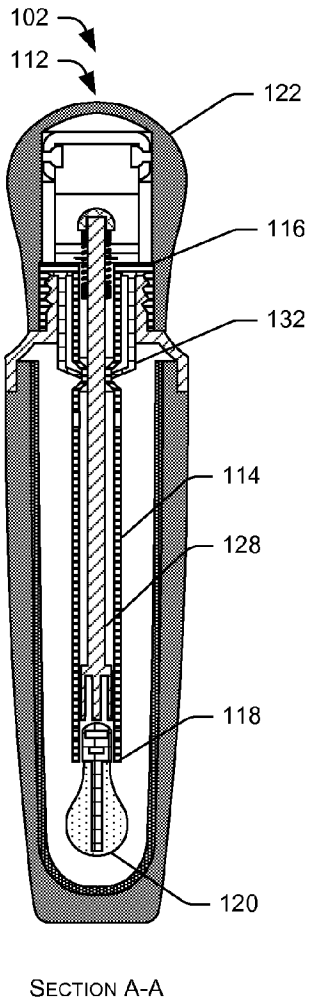
FIG. 1B depicts a cross-sectional view of the illustrative applicator system shown in FIG. 1A, taken along line A-A.
Figure 1A:
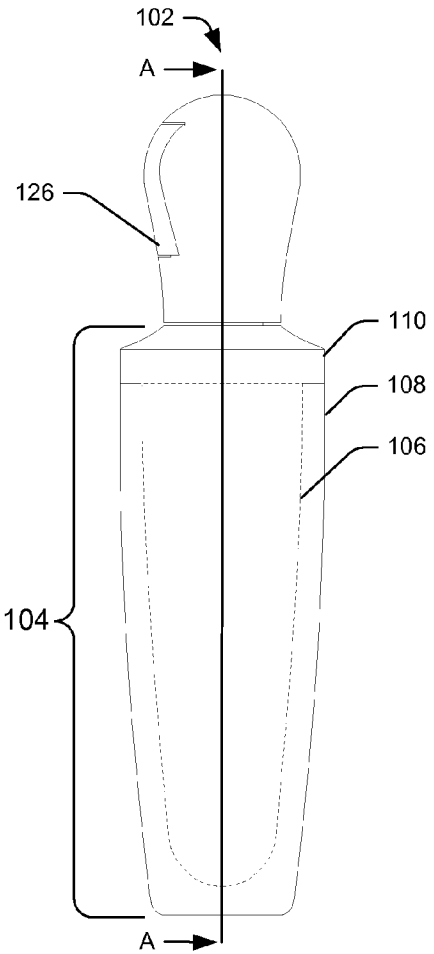
FIG. 1A depicts an illustrative applicator system for applying a product to a surface.

FIG. 1A depicts an illustrative applicator system 102, FIG. 1B depicts a respective cross sectional view A-A of the applicator system 102, and FIG. 1C depicts the adjustable implement housed by the applicator system of FIG. 1A. The applicator system 102 includes a receptacle assembly 104 with a reservoir 106 for containing a cosmetic, medicinal, personal care, or other product. In the illustrated embodiment, the receptacle assembly 104 further comprises a shell 108. Here, for instance, shell 108 is shown to have a clear plastic wall so the exterior of the reservoir 106 may be visible. In some implementations, the reservoir may also be made of clear plastic material, in which case, the contents of the reservoir may be visible. Further, while shell 108 is described here as being clear, it is contemplated that the shell 108 may be opaque. FIG. 1A also shows shell 108 and reservoir 106 coupled together via a collar 110. In other embodiments, the receptacle assembly may omit the shell as in the case of, for example, a reservoir assembly with a unitary body.

As illustrated, receptacle assembly 104 may comprise a substantially cup-shaped shell 108, cup-shaped reservoir 106, and ring-shaped collar 110 any of which may be formed of plastic (e.g., polypropylene (PP), acrylonitrile butadiene styrene (ABS), Polyoxymethylene (POM)) or any other suitable material, for example glass. Further, while receptacle assembly 104 is illustrated as a substantially cup-shaped assembly, a variety of receptacle shapes and types are contemplated. For example, the receptacle may be rectangular shaped, tubular shaped, triangular shaped or any other suitable receptacle shape. Additionally, while receptacle assembly 104 is illustrated as comprising a reservoir 106 housed in shell 108, receptacle assembly 104 may comprise only a unitary housing which includes a reservoir.

Additionally, section view A-A of the applicator system 102 is shown in FIG. 1B. FIG. 1B and FIG. 1C both show a view of an adjustable implement 112, which the applicator system 102 includes as one of its components. The adjustable implement 112 comprises a hollow stem 114 having a top end 116 and a bottom end 118. The bottom end 118 of the stem 114 has an applicator 120 pivotally coupled thereto. In FIG. 1B and FIG. 1C, applicator 120 comprises a bulb-shaped unit of bristles (bristles not shown) for application of a product such as mascara, foundation, blush, or other cosmetic products. While applicator 120 is shown here to be a bulb-shaped unit, other applicator shapes such as a shaft-shaped unit, ring-shaped unit, or the like are conceptualized. Adjustable implement 112 is further shown to have a cap 122 securely disposed on the top end 116 of stem 114. The cap 122 has a gripping surface area 124 and an actuator 126 that, in this example, comprises a portion of the gripping surface area 124 of cap 122, as shown in FIG. 1A and FIG. 1C. FIG. 1A and FIG. 1C show an actuator 126 as a button mechanism disposed on the side surface of the cap 122. However, alternative actuators are conceptualized. For example, actuator 126 may be a rotatable portion of cap 122, a squeezable portion of cap 122, or a switch mechanism.

In the illustrated example, the actuator 126 is connected to a mechanical linkage 128 housed in the hollow stem 114. However, in other examples the actuator 126 may be connected to the applicator via a hydraulic mechanism, an electrical mechanism, a pneumatic mechanism, a magnetic mechanism, or the like. Referring back to FIG. 1B, the linkage 128 is also mechanically connected to the applicator 120 disposed on the bottom end 118 of stem 114, thereby coupling both the actuator 126 and the applicator 120 such that the applicator 120 is selectively pivotable to about a ninety degree position 130, as shown in FIG. 1C. In some embodiments, receptacle assembly 104 may include a wiper 132 which may be housed in the collar 110. The wiper 132 is configured to remove any excess product (e.g., mascara) from the applicator 120 when the adjustable implement 112 is removed to apply the product to a body (e.g., eyelashes). For each description, the applicator is described in the context of an applicator for applying a mascara product to eyelashes. However, it should be understood that applicators as described herein may be used and adapted to apply other products and may be used to apply product to other portions of the body.

The applicator system 102 comprising an adjustable implement 112 configured to selectively pivot an applicator 120 to a ninety degree position 130, provides for the application of mascara to eyelashes at least at two distinct angles. This motion enables a user to apply mascara with a single applicator system 102 rather than multiple different applicators. Additionally, the applicator system 102 further enables the user to apply mascara with a single applicator, such as the bulb-shaped applicator 120 rather than using two distinctly shaped applicators to apply the mascara to eyelashes and achieve multiple desired effects (i.e., to volumize eyelashes and to separate and define eyelashes).

Specifically, with the adjustable implement 112 configured to selectively pivot the applicator 120 to a substantially ninety degree angle 130, this allows the user to first apply the mascara to the eyelashes using a side of the applicator while the applicator 120 is not selectively pivoted to the ninety degree position 130. The user can selectively pivot the applicator to the ninety degree position 130 and apply the product to the eyelashes using another side of the applicator 120. As discussed in more detail below, the different sides of the applicator may have different size, shape, spacing or other characteristics.

Figure 2:
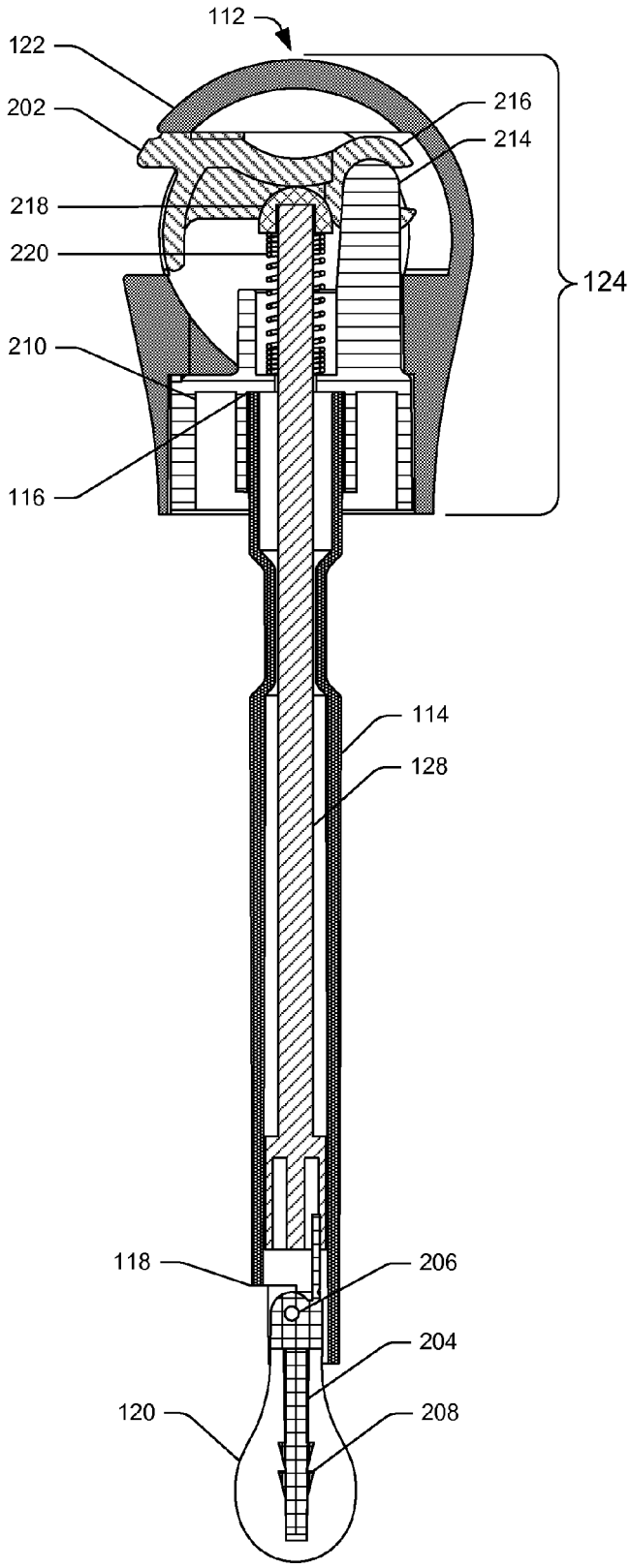
FIG. 2 is an enlarged cross-sectional view showing additional details of the illustrative adjustable implement of FIG. 1B.

FIG. 2 is an enlarged section view of the adjustable implement 112 shown in FIG. 1B. In this implementation, the actuator 126 comprises a side lever actuator 202. The adjustable implement 112 shown in FIG. 2 presents some of the same components shown in both FIG. 1B and FIG. 1C in greater detail. For instance, the adjustable implement shown in FIG. 2 shows hollow stem 114, top end 116, bottom end 118, applicator 120, cap 122, linkage 128 and gripping surface 124. FIG. 2 further shows additional details of the applicator insert 204 pivotally coupled to bottom end 118 of stem 114 via pivot 206. While applicator insert 204 is shown here in FIG. 2 to have barb(s) 208 that are configured to receive and securely hold one illustrative applicator 120 (e.g., bulb-shaped applicator), additional alternative fastening mechanisms or techniques are contemplated. For example, applicator insert 204 may be configured to receive and securely hold an applicator 120 by way of adhesive, fastener, threads, or the like. Here, applicator 120 is shown as a bulb-shaped unit, however applicator 120 could be a shaft-shaped unit, ring-shaped unit, or any other suitable applicator shape. Also shown in FIG. 2 is an inner cap 210 securely fixed to top end 116 of stem 114 Inner cap 210 may be securely fixed to top end 116 of stem 114 via adhesive, fasteners threads or any other suitable fastening means. In addition to being securely fixed to top end 116 of stem 114, as shown in FIG. 2, inner cap 210 is also securely fixed to the inside of cap 122 Inner cap 210 may be securely fixed to the inside of cap 122 via adhesive, fasteners threads or any other suitable fastening means.

Additionally, while FIG. 2 shows adjustable implement 112 with a side lever actuator 202, other actuators 126 are contemplated that in the arrangement of components shown in FIG. 2 displace the linkage 128 and rotate applicator 120 about pivot 206. For example, adjustable implement 112 may comprise a button actuator disposed on a side portion of cap 122 that moves linkage 128 and applicator 120, or adjustable implement 112 may comprise a button disposed on a top portion of cap 122 that moves linkage 128 and applicator 120.

In the embodiment of FIG. 2, adjustable implement 112 comprises a side lever actuator 202 pivotally attached to an anchor 214 of inner cap 210 via a clasp end 216 of side lever actuator 202. While FIG. 2 shows side lever actuator 202 pivotally attached to anchor 214 of inner cap 210 as a clasp 216, other types of pivots are contemplated. For example, clasp end 216 may be a clamp, tong, hook, bearing or any other pivot device. Side lever 202 also contacts linkage 128 via linkage cap 218. Spring 220 is disposed about the outside portion of linkage 128 and sandwiched between linkage cap 218 and inner cap 210. Therefore, when side lever actuator 202 is displaced, clasp end 216 rotates about anchor 214 while linkage cap 218 acts as a load point, allowing the side lever actuator 202 to displace linkage 128 as well as compress spring 220. In this implementation, the spring 220 is configured to displace the side lever actuator 202 back to an original position (i.e., to the position before the side lever actuator 202 was actuated or displaced). As discussed above, additional actuators 126 are contemplated that, in the arrangement of components shown in FIG. 2, displace the linkage 128 and rotate applicator 120 about pivot 206. Furthermore, hollow stem 114 guides linkage 128 along the inside portion of the hollow stem 114.

As illustrated, adjustable implement 112 may comprise a domed cap 122, hollow stem 114, tubular linkage 128, and an applicator insert 204 that may be formed of plastic (e.g., polypropylene (PP), acrylonitrile butadiene styrene (ABS), Polyoxymethylene (POM)), metal, or any other suitable material. Likewise, bulb-shaped unit applicator 120 may be formed of rubber, thermoplastic elastomers (TPE), plastic (e.g. polypropylene (PP)), fabric mesh, or any other suitable material. Furthermore, it is contemplated that bulb-shaped unit applicator 120 may be formed integrally with bristles as an injection molded unit, as a series of installed bristles (e.g., like a toothbrush), as a series of tied bristles (e.g., like a pipe cleaner), or other configuration.

Figure 3B:
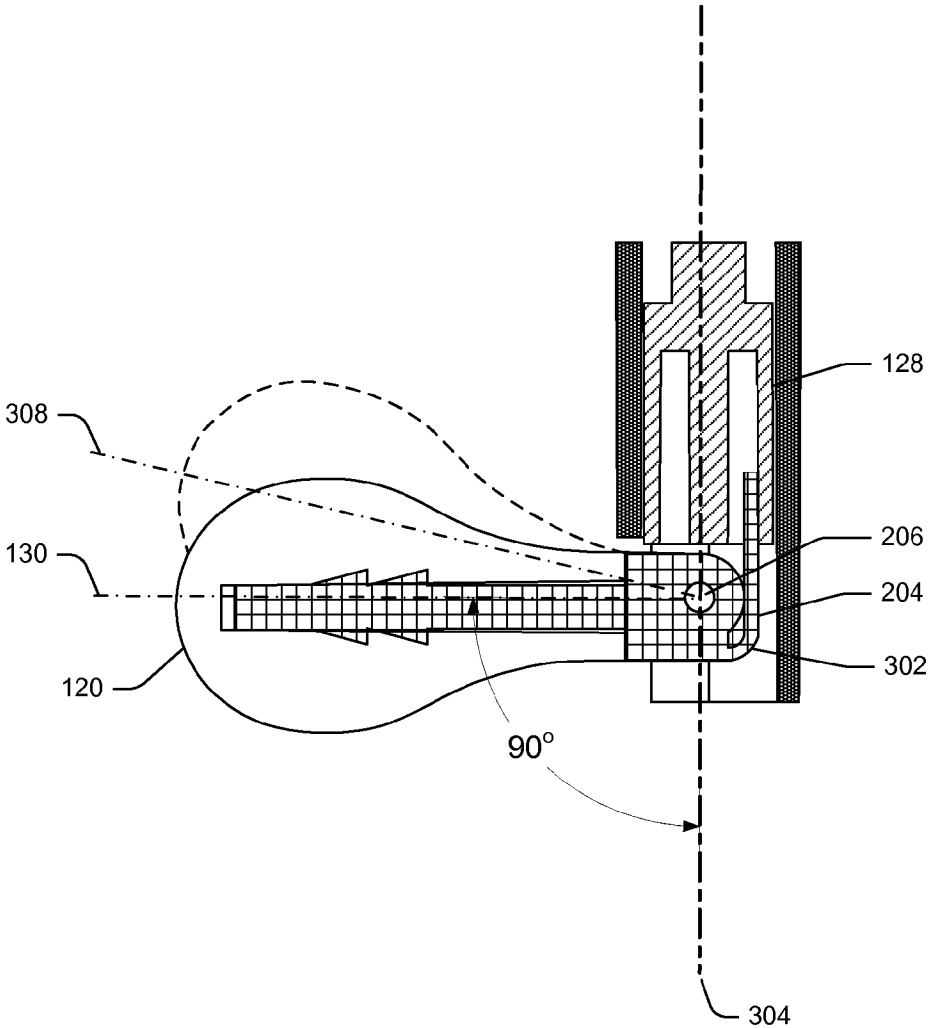
FIG. 3A and FIG. 3B depict detail section views of an applicator in first and second positions.
Figure 3A:
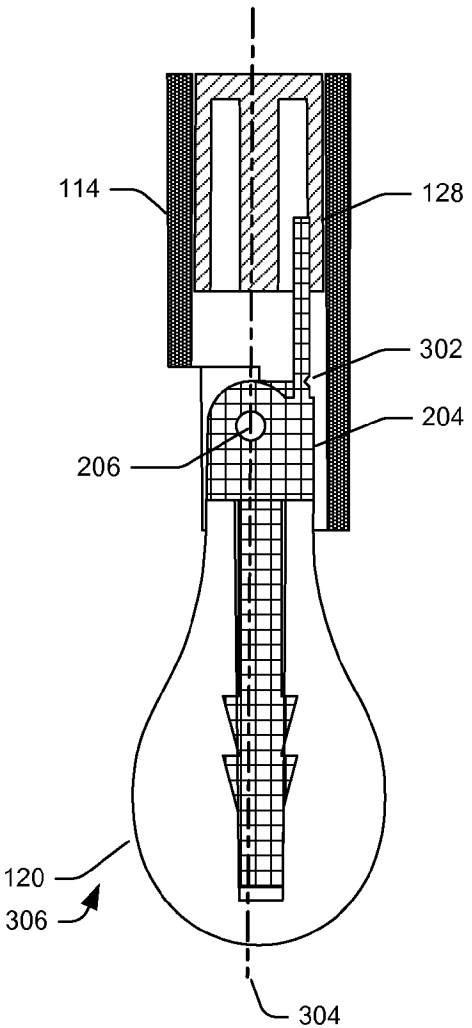

FIG. 3A and FIG. 3B illustrate detail section views of the applicator end of the implement 112 in first (3A) and second (3B) positions. In this example, a living hinge 302 of implement 112 facilitates the ninety degree pivoting of applicator 120 about a single pivot 206 when actuator 126 is actuated. While the living hinge 302 is shown in this embodiment as a triangular shaped notch disposed in applicator insert 204, other embodiments of living hinge 302 may comprise a thin walled section of the applicator insert 204, a hollow walled section of the applicator insert 204, one or more smaller notches disposed along an edge of the applicator insert 204 (e.g., arranged on a right side of the applicator insert 204, arranged on a left side of the applicator insert 204, arranged on both sides of the applicator insert 204, or in any other suitable location). Likewise, while the applicator insert 204 is depicted generally as a rectangular arm substantially fixed to linkage 128, in other embodiments, the applicator insert 204 may be configured in any other suitable shape, size and configuration. It is contemplated that applicator insert 204 may be fixed to linkage 128 via adhesive, fastener, compression fit, or be molded of the same piece of material as linkage 128.

In one embodiment, as shown in FIG. 3A and FIG. 3B, a living hinge 302 is shown to be disposed on an outside portion of applicator insert 204. Specifically, the living hinge 302 is shown to reside just above pivot 206 when a user is not actuating the actuator 126. When the adjustable instrument 112 is not selectively pivoted, applicator insert 204 and likewise applicator 120 are positioned in line with longitudinal axis 304 of the adjustable instrument 112 that is centered on pivot 206, as shown in FIG. 3A. This defines an original position 306, in which the adjustable instrument 112 is not being selectively pivoted. However, when adjustable instrument 112 is selectively pivoted and applicator insert 204 and likewise applicator 120 are positioned as shown by the ninety degree pivot position 130 in FIG. 3B, living hinge 302 is displaced down, via linkage 128, to a position below pivot 206. In this embodiment, the ninety degree pivot position 130 is described as being generated while the actuator 126 is actuated, thereby selectively pivoting the applicator insert 204 and likewise applicator 120. While applicator 120 is shown here to be pivotable about a pivot 206 via a living hinge, other pivoting mechanisms, such as substituting the living hinge with an additional hinge pin, are also possible.

In some implementations, a locking mechanism (not shown) to temporarily lock the applicator insert 204 and likewise applicator 120 in the ninety degree pivot position 130 is also contemplated. In addition to the locking mechanism, a complementary un-locking mechanism is also conceptualized. The un-locking mechanism may un-lock the locking mechanism by way of selectively activating actuator 126 for an additional time (e.g., much like the locking and un-locking of a retractable ball-point pen). When a locking mechanism is provided, the applicator 120 could be selectively pivoted and or locked in any number of positions. For example, the applicator 120 may be selectively pivoted and or locked anywhere within about a ninety degree range.

In the illustrated example, the living hinge 302 is designed to enable applicator insert 204 and likewise applicator 120 to return to the original vertical position 306. More specifically, when the adjustable implement 112 is no longer selectively pivoting the applicator 120 via actuator 126, a spring 220 returns linkage 128 back to its original position and likewise linkage 128 displaces applicator insert 204 back to original position 306. In other embodiments, applicator 120 may be configured to pivot more or less than ninety degrees. FIG. 3B illustrates applicator 120 in broken lines pivoted to position 308, where applicator 120 is pivoted beyond the ninety degree pivot position 130.

Figures 4A, 4B:
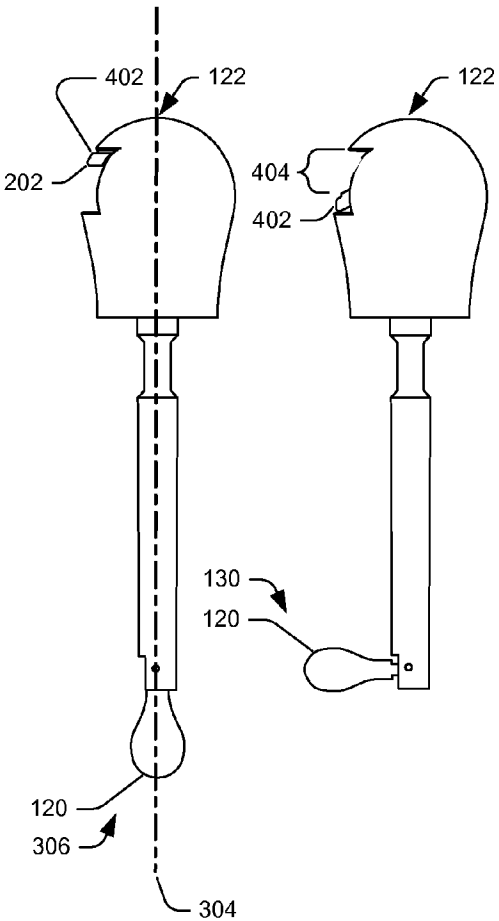
FIG. 4A and FIG. 4B depict an illustrative side lever actuator in first and second positions.
Figures 5A, 5B:
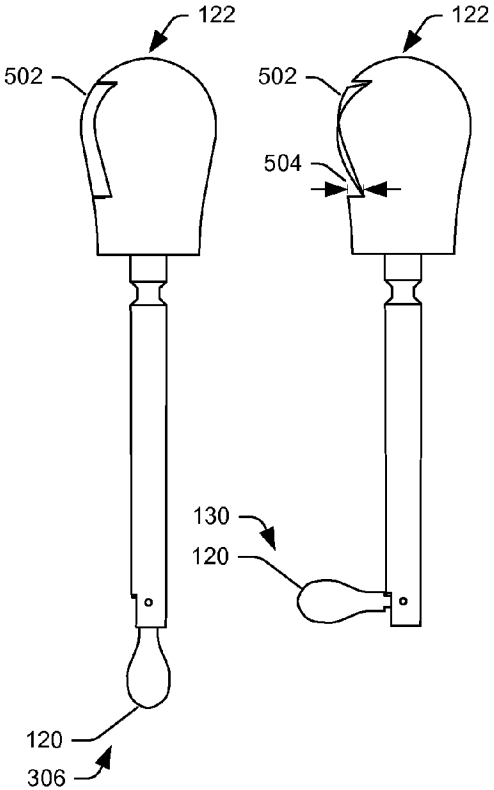
FIG. 5A and FIG. 5B depict an illustrative side button actuator in first and second positions.
Figures 6A, 6B:
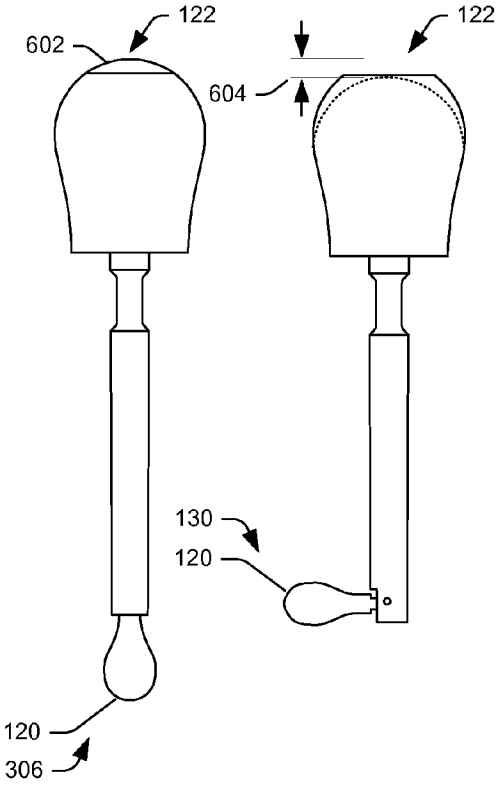
FIG. 6A and FIG. 6B depict an illustrative top button actuator in first and second positions.
Figures 8A, 8B:
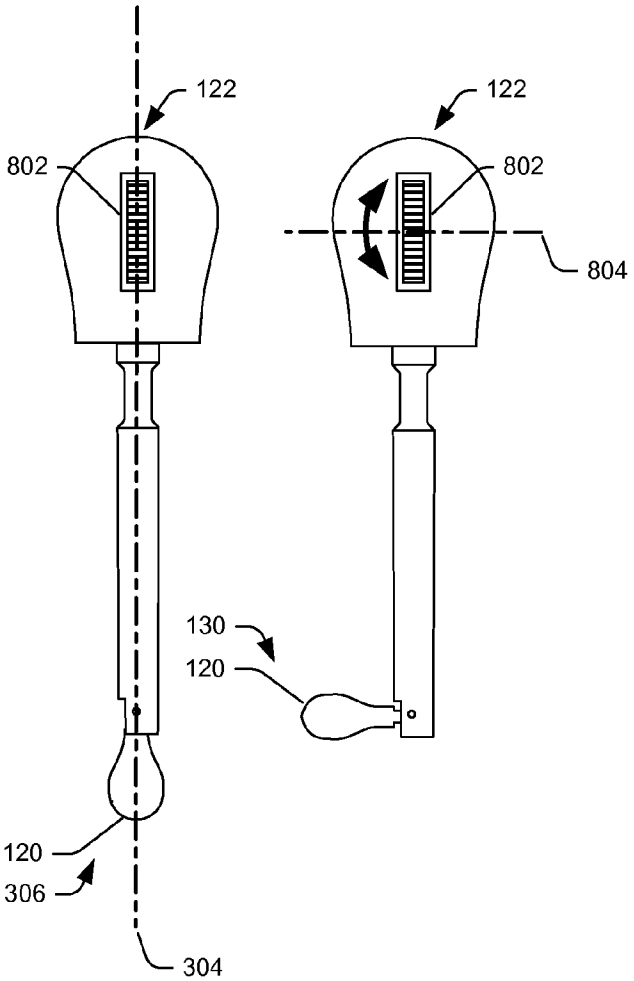
FIG. 8A and FIG. 8B depict an illustrative dial actuator in first and second positions.
Figures 7A, 7B:
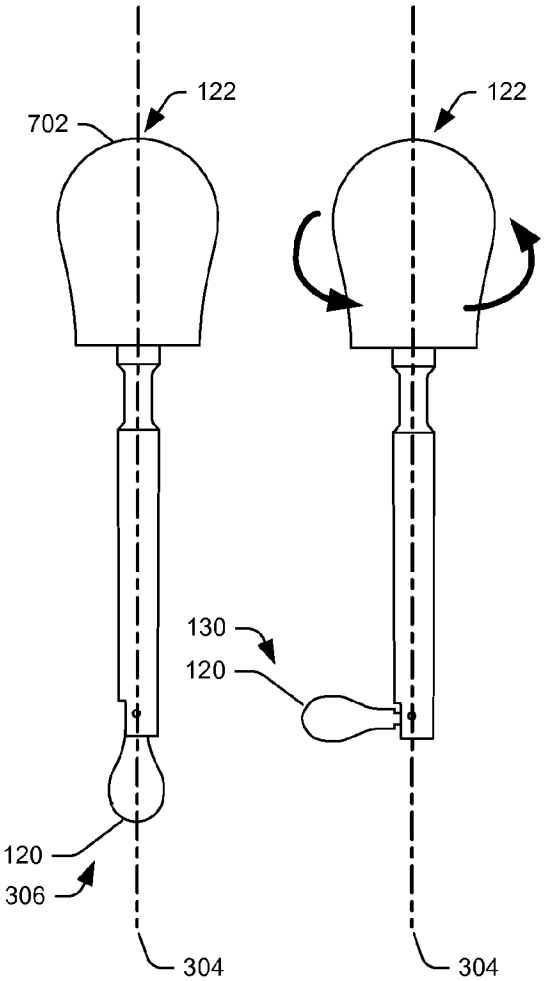
FIG. 7A and FIG. 7B depict an illustrative a rotating cap actuator in first and second positions.

FIGS. 4A and 4B, FIGS. 5A and 5B, FIGS. 6A and 6B, FIGS. 7A and 7B and FIGS. 8A and 8B depict five illustrative adjustable implements that may be used with receptacle assembly 104 of FIG. 1, each having different actuators. FIGS. 4A and 4B illustrate an adjustable implement with the side lever actuator 202. FIGS. 5A and 5B illustrate an adjustable implement with a side button actuator 502. FIGS. 6A and 6B illustrate an adjustable implement with a top button actuator 602. FIGS. 7A and 7B illustrate an adjustable implement with a rotatable actuator. FIGS. 8A and 8B illustrate an adjustable implement with a dial actuator.

Turning now to FIG. 4A and FIG. 4B, FIG. 4A illustrates side lever actuator 202 before a user displaces said side lever actuator 202. Specifically, FIG. 4A illustrates side lever actuator 202 having a lever 402 that protrudes slightly from the gripping surface area 124 of cap 122. Lever 402 is configured to be displaced a distance 404 towards the applicator 120. Additionally, FIG. 4A further illustrates the applicator 120 in the original vertical position 306, before lever 402 is displaced the distance 404 axially. Upon being displaced the distance 404, lever 402 is illustrated in FIG. 4B as being temporarily displaced toward applicator 120. Likewise, FIG. 4B further illustrates the applicator 120 in the ninety degree pivot position 130 as a result of the lever 402 being displaced axially relative to longitudinal axis 304 of the adjustable instrument. While FIGS. 4A and 4B illustrate a lever 402 other mechanical means are contemplated. For example a raised bump, a detent, or any other means to enable a user to selectively displace the side lever actuator 202 axially relative to longitudinal axis 304 of the adjustable instrument. It is contemplated that a locking mechanism (not shown) may be produced by pushing the lever 402 in a transverse direction into a receptacle or groove in the cap (also not shown).

Turning now to FIG. 5A and FIG. 5B, FIG. 5A illustrates side button actuator 502 before a user displaces said side button actuator 502 laterally relative to longitudinal axis 304 of the adjustable instrument. Specifically, FIG. 5A illustrates side button actuator 502 comprising a portion of the side surface of the gripping surface area 124 of cap 122. Furthermore, side button actuator 502 is illustrated in FIG. 5A as being substantially flush with the gripping surface area 124 of cap 122 before being displaced by a user. In addition to being substantially flush with the gripping surface area 124 before being displaced, side button actuator 502 is illustrated in FIG. 5A as comprising the same side contour (i.e., domed contour) as the side portion of cap 122. Side button actuator 502 is configured to be displaced a distance 504 in the direction of the cap 122 (i.e., laterally relative to longitudinal axis 304 of the adjustable instrument). FIG. 5A further illustrates the applicator 120 in the original vertical position 306, before side button 502 is displaced the distance 504 laterally. Upon being displaced the distance 504, button 502 is illustrated in FIG. 5B as being temporarily displaced toward the inside portion of the cap 122. Additionally, FIG. 5B further illustrates the applicator 120 in the ninety degree pivot position 130 as a result of the button 502 being displaced the distance 504 laterally relative to longitudinal axis 304 of the adjustable instrument.

With respect to FIG. 6A and FIG. 6B, FIG. 6A illustrates top button actuator 602 before a user displaces the top button actuator 602 axially relative to longitudinal axis 304 of the adjustable instrument. Specifically, FIG. 6A illustrates top button actuator 602 comprising a portion of the top surface of the gripping surface area 124 of cap 122. Furthermore, top button actuator 602 is illustrated in FIG. 6A as being substantially flush with the gripping surface area 124 of cap 122 before being displaced by a user axially. In addition to being substantially flush with the gripping surface area 124 before being displaced, top button actuator 602 is illustrated in FIG. 6A as comprising the same top contour (i.e., dome shaped contour) as the top portion of cap 122. Top button actuator 602 is configured to be displaced a distance 604 in the direction of the applicator 120 (i.e., axially relative to longitudinal axis 304 of the adjustable instrument). FIG. 6A further illustrates applicator 120 in original vertical position 306, before top button actuator 602 is displaced the distance 604 axially. Upon being displaced the distance 604, top button actuator 602 is illustrated in FIG. 6B as being temporarily displaced toward the inside portion of cap 122 and in the direction of applicator 120. Additionally, FIG. 6B further illustrates applicator 120 in the ninety degree pivot position 130 as a result of the button 502(B) being displaced axially.

FIGS. 7A and 7B illustrate a rotating cap actuator 702. Here, the rotating cap actuator 702 is configured to be rotatable about longitudinal axis 304 of the applicator. While FIG. 7B illustrates rotating cap actuator 702 being displaced rotationally about longitudinal axis 304 in a clock wise direction, a counter-clock wise direction is also contemplated. FIG. 7A further illustrates applicator 120 in original vertical position 306, before rotating cap actuator 702 is displaced rotationally about longitudinal axis 304. Upon being displaced rotationally, applicator 120 pivots to the ninety degree pivot position 130 shown in FIG. 7B.

FIGS. 8A and 8B illustrate a dial actuator 802. Here, the dial actuator 802 comprises a rotatable dial exposed on a side of the cap 122. The dial actuator 802 is configured to be rotatable about an axis 804 transverse to longitudinal axis 304 of the applicator. FIG. 8A illustrates applicator 120 in original vertical position 306, before dial actuator 802 is displaced rotationally about axis 804. Upon being displaced in either the clock wise direction or the counter-clock wise direction, applicator 120 moves to the ninety degree pivot position 130 shown in FIG. 8B.

While FIGS. 4A and 4B, FIGS. 5A and 5B, FIGS. 6A and 6B, FIGS. 7A and 7B, and FIGS. 8A and 8B depict five illustrative adjustable implements, each having different actuators 126, other types of actuators are also possible.

Illustrative Applicators

Figure 10:
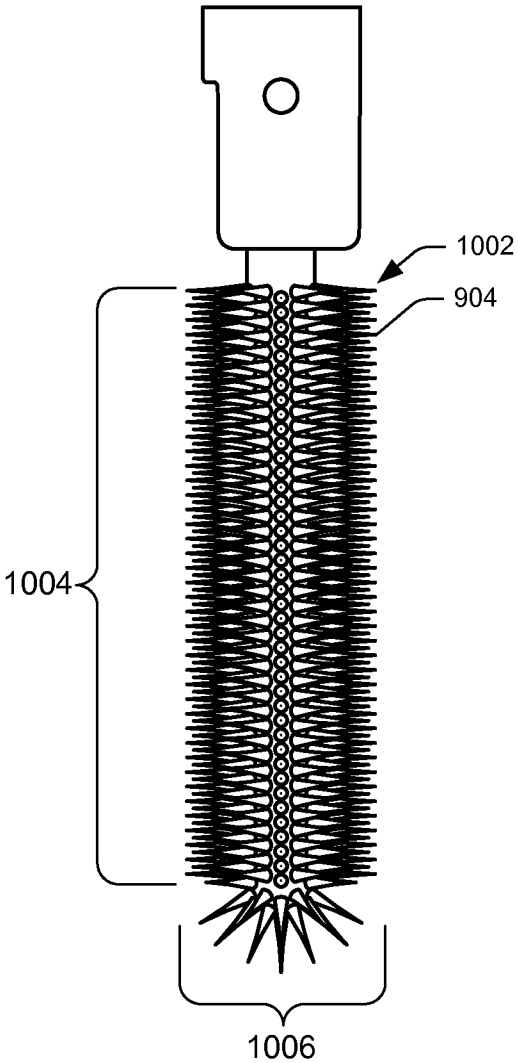
FIG. 10 depicts an illustrative applicator that is a shaft-shaped unit of bristles.
Figure 9:
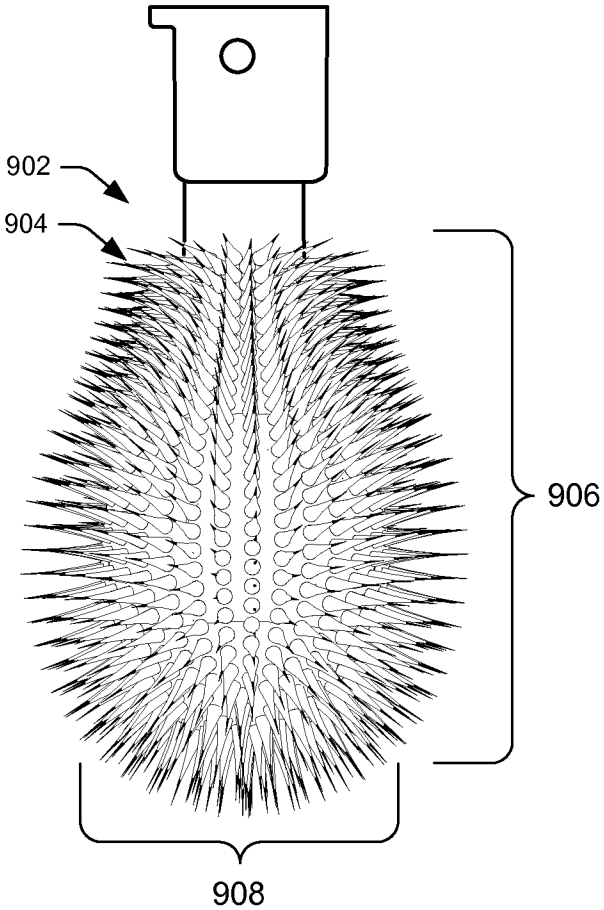
FIG. 9 depicts an illustrative applicator that is a bulb-shaped unit of bristles.

FIG. 9 and FIG. 10 illustrate two types of applicator 120, each pivotally coupled to an adjustable implement. The applicator 120 shown in FIG. 9 is a bulb-shaped unit of bristles 902. The bristles 904 may comprise multiple columns, each column having a different bristle length and wherein the different columns of bristle lengths are staggered to increase the density of the bristles. Additionally, bulb-shaped unit 902 may comprise a longitudinal surface 906 and a latitudinal surface 908. Longitudinal surface 906 may comprise short, densely arrayed bristles and latitudinal surface 908 may comprise longer, less dense arrayed bristles. Furthermore, longitudinal surface 906 may be used by a user while the applicator 120 is in original position 306 and latitudinal surface 908 may be used by a user while the applicator 120 is in the ninety degree pivot position 130. The longitudinal surface 906 may support eyelash volume while the latitudinal surface 908 may support eyelash separation and definition. As discussed above, bulb-shaped unit 902 may be formed as one unit comprising rubber, thermoplastic elastomers (TPE), plastic (e.g. polypropylene (PP)), fabric mesh, or any other suitable material.

With respect to FIG. 10, the applicator 120 is a shaft-shaped unit of bristles 1002. Again, here the bristles 904 may comprise multiple columns, each column having a different bristle length and wherein the different columns of bristle lengths are staggered to increase the density of the bristles. The shaft-shaped unit 1002 may also comprise a longitudinal surface 1004 and a latitudinal surface 1006. Longitudinal surface 1004 may comprise short, densely arrayed bristles and latitudinal surface 1006 may comprise longer, less dense arrayed bristles. Furthermore, longitudinal surface 1004 may be used by a user while the applicator 120 is in original position 306 and latitudinal surface 1006 may be used by a user while the applicator 120 is in the ninety degree pivot position 130. The longitudinal surface 1004 may support eyelash volume while the latitudinal surface 1006 may support eyelash separation and definition. Similarly, as discussed above, shaft-shaped unit 1002 may be formed as one unit comprising rubber, thermoplastic elastomers (TPE), plastic (e.g. polypropylene (PP)), fabric mesh, or any other suitable material. It is also contemplated that shaft-shaped unit of bristles 802 may be an injection molded unit, a series of installed bristles (e.g., like a toothbrush), a series of tied bristles (e.g., like a pipe cleaner), or other configuration.

Exemplary Method of Using Adjustable Implement

Figure 11:
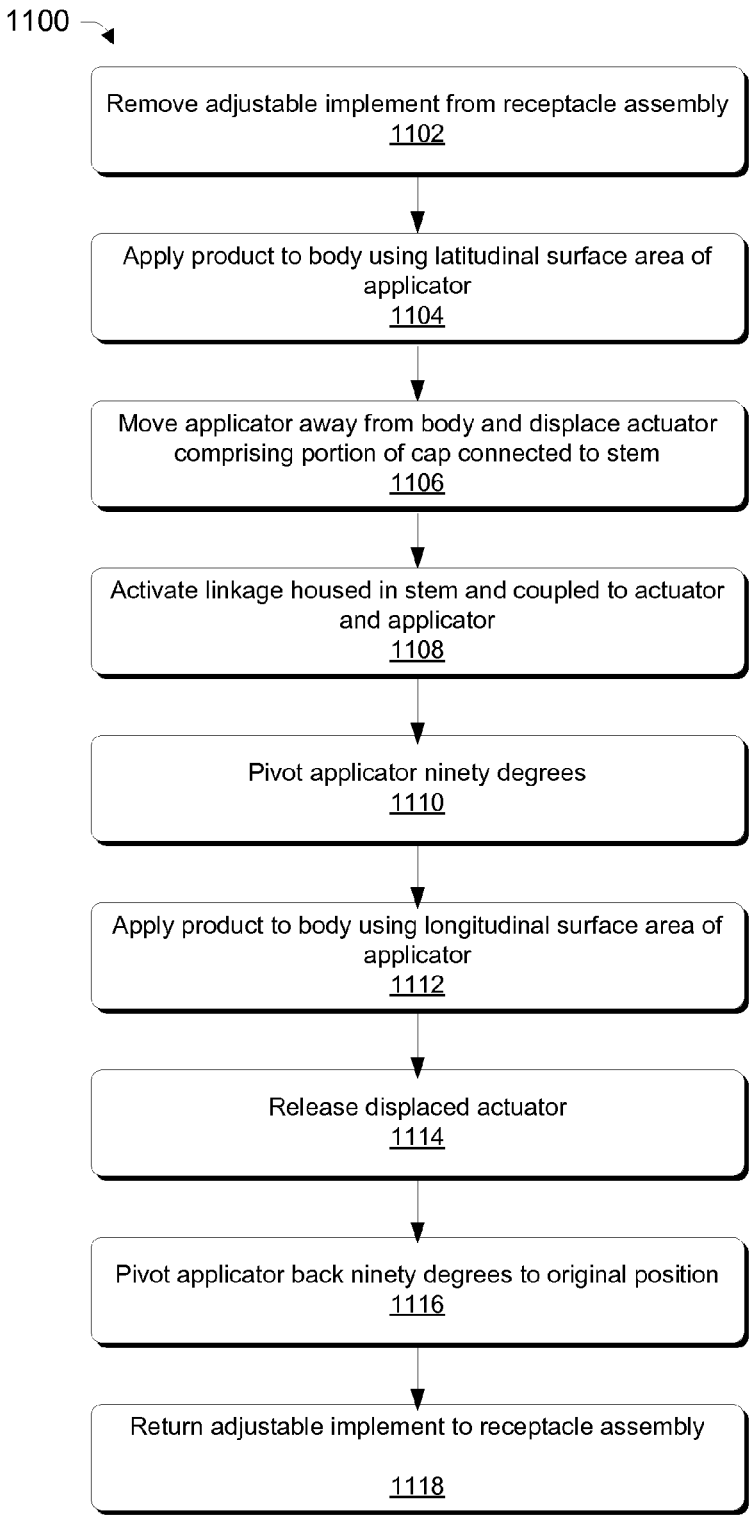
FIG. 11 is a flow diagram of an illustrative process for using the adjustable implement.

FIG. 11 is a flow diagram of an example process 1100 which may, but need not necessarily be performed using the adjustable implement 112 of FIG. 1. For convenience, the process 1100 will be described with reference to the adjustable implement 112, but the process 1100 is not limited to use with this implement. For instance, a user may perform this process 1100 to apply mascara to eyelashes, or a user may perform this process to remove a substance from a body. In some instances, the user may perform this process in a manufacturing environment, in a commercial environment (e.g., beauty salon), or in a place of residence. While FIG. 11 illustrates a process 1100 for applying product to eyelashes, it is to be appreciated that this process may apply to applying any type substances to any type of body (e.g., applying touch-up paint to a vehicle).

Process 1100 includes an operation 1102, which represents removing an adjustable implement 112 from a receptacle assembly 104. Next, operation 1104 represents applying mascara to eyelashes using a latitudinal surface (908 or 106) of applicator 120 to achieve a desired effect (i.e., eyelash volume). Operation 1104 is followed by operation 1106, which represents moving the adjustable implement 112 away from the eyelashes and displacing the actuator 126. Here, as discussed above with respect to FIGS. 4A and 4B, FIGS. 5A and 5B, FIGS. 6A and 6B, FIGS. 7A and 7B, and FIGS. 8A and 8B the actuator could be displaced laterally, axially, rotatably, or any other displacing means. Further, and as discussed above, the actuator 126 may in some embodiments comprise a portion of the gripping surface area 124 of cap 122. Next, process 1100 proceeds to operation 1108, which represents the displaced actuator 126 activating a linkage 128 housed in hollow stem 114, coupled to the actuator 126 and applicator 120, wherein the applicator 120 is pivotally connected to the stem 114. Operation 1108 is followed by operation 1110, which represents pivoting the applicator 120 to a ninety degree position 130. Following the pivoting of the applicator 120, the applicator 120 may be locked in the ninety degree position 130. Process 1100 continues with operation 1112, which represents applying mascara to the eyelashes using the longitudinal surface area (906 or 1004) of applicator 120 to achieve a desired effect (i.e., separation and definition). At operation 1114, a user releases the displaced actuator 126, after which, at operation 1116, the applicator 120 rotates back to its original position 306. Finally, process 1100 is complete when, at operation 1118, a user may return the adjustable implement 112 to receptacle assembly 104.

Conclusion

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely. For example, the shape, size, and configuration of the housing, reservoir, cap, and adjustable implement may be varied.

What is claimed is:

1. An applicator system for applying a product to a surface, the applicator system comprising:

an adjustable implement comprising:

a stem having a top end and a bottom end;

an applicator pivotally coupled to the bottom end of the stem, the applicator comprising a living hinge for pivoting the applicator about a single pivot and being pivotable at least about 90 degrees;

a cap securely disposed on the top end of the stem, the cap comprising:

a gripping surface area; and an actuator for selectively pivoting the applicator;

a linkage housed in the stem coupling the applicator to the actuator; and a receptacle assembly for receiving the adjustable applicator.

2. The applicator system according to claim 1, wherein the receptacle assembly comprises:

a reservoir for containing the product; and a wiper mechanism disposed on the top of the reservoir for collecting an excess amount of the product disposed on the applicator.

3. The applicator system according to claim 1, wherein the actuator is a button comprising a portion of a side surface of the gripping surface area and is configured to selectively pivot the applicator.

4. The applicator system according to claim 1, wherein the actuator is a button comprising a portion of a top surface of the gripping surface area and is configured to selectively pivot the applicator.

5. The applicator system according to claim 1, wherein the actuator is a lever protruding from a side of the gripping surface area and is configured to selectively pivot the applicator.

6. The applicator system according to claim 1, further comprising a locking mechanism to hold the applicator in a selectable position.

7. The applicator system according to claim 1, wherein the cap comprises a rotatable portion and a fixed portion, wherein the rotatable portion is coupled to the linkage and configured to selectively pivot the applicator.

8. The applicator system according to claim 1, wherein the applicator is a bulb-shaped unit of bristles configured to be selectively pivoted by the actuator.

9. The applicator system according to claim 1, wherein the applicator is a shaft-shaped unit of bristles configured to be selectively pivoted by the actuator.

10. The applicator system according to claim 1, wherein the applicator comprises thermoplastic elastomers (TPE), rubber, or polypropylene or (PP).

11. The applicator system according to claim 1, further comprising a product, wherein the product comprises mascara.

12. An adjustable cosmetic implement comprising:

a stem having a top end and a bottom end;

a linkage housed in the stem;

an applicator pivotally coupled to the bottom end of the stem, the applicator comprising a living hinge for pivoting the applicator about a single pivot;

a cap configured to engage a receptacle, the cap securely disposed on a top end of the stem;

a button comprising a portion of a surface area of the cap; and the linkage housed in the stem coupling the applicator and the button.

13. The adjustable implement according to claim 12, wherein the adjustable implement is configured to selectively pivot the applicator between a first position and a second position, the second position being about ninety degrees from the first position.

14. The adjustable applicator according to claim 12, wherein the button comprises a portion of a side surface of the cap and is configured to selectively pivot the applicator.

15. The adjustable applicator according to claim 12, wherein the button comprises a portion of a top surface of the cap and is configured to selectively pivot the applicator.

16. The adjustable applicator according to claim 12, wherein the applicator is a bulb-shaped unit of plastic bristles configured to be selectively pivoted in response to actuation of the actuator.

17. The adjustable applicator according to claim 12, wherein the applicator is a shaft-shaped unit of plastic bristles configured to be selectively pivoted in response to actuation of the actuator.

* * * * *